United States Patent [19]

Saffari

[11] Patent Number: 4,706,383

[45] Date of Patent: Nov. 17, 1987

[54] ELECTRICAL CONTACT ASSEMBLY WITH COMPOSITE CONTACT CONSTRUCTION

[75] Inventor: Akbar Saffari, Freeport, Ill.

[73] Assignee: Honeywell Inc., Minneapolis, Minn.

[21] Appl. No.: 923,799

[22] Filed: Oct. 27, 1986

[51] Int. Cl.[4] ..... H01R 43/02

[52] U.S. Cl. ..... 29/879

[58] Field of Search ..... 29/874, 876, 877, 878, 29/879, 875; 200/268; 428/582

[56] References Cited

U.S. PATENT DOCUMENTS

| | | | |
|---|---|---|---|
| 2,425,053 | 8/1947 | Swinehart | 29/875 |
| 2,468,888 | 5/1949 | Mekelburg | 200/265 |
| 3,258,830 | 7/1966 | Pityo | 29/879 |
| 4,342,893 | 8/1982 | Wolf | 29/878 |

FOREIGN PATENT DOCUMENTS

| | | | |
|---|---|---|---|
| 46213 | 3/1980 | Japan | 29/879 |
| 217912 | 12/1984 | Japan | 29/879 |
| 653796 | 5/1951 | United Kingdom | 29/875 |
| 910859 | 11/1962 | United Kingdom | 29/876 |
| 1048520 | 11/1966 | United Kingdom | 29/877 |

*Primary Examiner*—William R. Briggs
*Attorney, Agent, or Firm*—Charles L. Rubow

[57] ABSTRACT

A method of producing a nonwelding contact assembly for an electrical switch using a composite contact material formed by extruding a metal oxide core surrounded by a metal or metal alloy sheath with good welding properties to form a wire of core material having a layer of the metal or metal alloy metallurgically bonded thereto. A segment of the wire is resistance welded to a contact carrier and coined to the desired contact shape, after which the layer on the contact surface is sufficiently thin that it is oxidized to provide nonwelding characteristics after a few switch operations.

17 Claims, 5 Drawing Figures

ELECTRICAL CONTACT ASSEMBLY WITH COMPOSITE CONTACT CONSTRUCTION

BACKGROUND OF THE INVENTION

The present invention relates generally to electrical contact materials and assemblies, and more particularly to a method of producing a welded contact assembly having a nonwelding electrical contact surface and to a composite material for producing such a contact assembly.

It is necessary and well known in connection with electrical switches for high current and high voltage applications to use a contact material which resists welding to prevent fusing of electrical contacts due to arcing upon breaking and/or making of the contacts. However, the same properties which make a material suitable for nonwelding contacts also limit the assembly and fabrication processes which can be used. With such materials, heat based bonding methods such as soldering, brazing or welding are difficult to use, and adhesion of the contact to the contact carrier may not be structurally sound. Further, the electrical properties of such an assembly may be adversely affected. Yet further, contact materials made of silver and metal oxide composites, which have highly desirable nonwelding properties, cannot be practically welded by resistance welding methods. This is a distinct disadvantage because resistance welding is one of the most inexpensive, simple and reliable methods of attaching a contact to a contact carrier.

A variety of techniques have been attempted to permit the use of welding in attaching contacts having nonwelding characteristics to contact carriers. One approach has been to form a layer of a metal oxide on a base material having good welding properties. The base material can then be welded to the contact carrier and the oxide layer on the base material forms the electrical contact surface. Another approach has been to form or bond a layer of material having good welding characteristics on a nonwelding material which provides the electrical contact surface. For example, U.S. Pat. No. 2,425,053 issued to M. Swinehart on Aug. 5, 1947 and U.S. Pat. No. 2,468,888 issued to H. Mekelburg on May 3, 1949 each disclose electrical contacts which are individually formed by placing a layer of silver or silver alloy powder in a suitable die cavity, that layer then being covered with a layer of a suitable metal oxide powder. Thereafter the powder in the cavity is subjected to a high pressure molding operation and heat sintering. The resulting contact has a nonwelding metal oxide electrical contact surface and a metal backing which exhibits good welding properties. A disadvantage is that this process, in which the contacts are individually formed, is relatively slow and expensive.

Another technique is shown in U.S. Pat. No. 4,342,893 issued to H. Wolf on Aug. 3, 1982. In this technique, a ribbon of composite contact material is formed by a rolling process in which a wire of a metal oxide is rolled together with one or more wires of a metal such as a silver copper alloy solder to form a tape material having a nonwelding electrical contact surface and one or more beads of a material with good welding properties on the opposite surface for permitting welding of segments of the tape to a contact carrier. One of the disadvantages of a rolling operating is that it cannot be conducted at the temperature sufficiently high to achieve a metallurgical bond between the metal alloy and metal oxide materials. For present purposes, a metallurgical bond is defined to be a bond in which there is significant diffusion of the two materials into one another at their interface. A metallurgical bond between the metal and metal oxide materials is desirable and/or necessary in order to achieve required structural properties of the composite contact material and of the contact/contact carrier assembly. In the technique described in the previously identified Wolf patent, if a sufficiently high temperature for achieving a metallurgical bond is used, the metal and/or metal oxide materials would tend to adhere to the forming rollers.

The applicant has avoided the foregoing problems by providing a hot extruded composite contact material and method of producing electrical switch contact assemblies in which a true metallurgical bond is formed between the nonwelding metal oxide material and a metal layer having good welding characteristics. The composite contact material is economically producible in wire form and suitable for use in highly integrated automatic switch assembly processes and machines.

SUMMARY OF THE INVENTION

The invention is a method of producing a composite electrical contact material and a welded contact assembly using such material, the contact assembly having nonwelding characteristics at its electrical contact surface. The composite material is produced by forming a cylindrical core of a first metallic material having nonwelding characteristics and a tubular sleeve of a second metallic material having good welding properties. The core is positioned within the sleeve to form a slug which is extruded under high temperature into a wire having a core of the first material with an outer layer of the second material metallurgically bonded thereto. The contact assembly is produced by forming a contact carrier, welding a segment of the wire containing sufficient material to form a desired contact onto the contact carrier, and coining the segment to the desired contact shape.

DESCRIPTION OF THE PREFERRED EMBODIMENT

Figure 1:
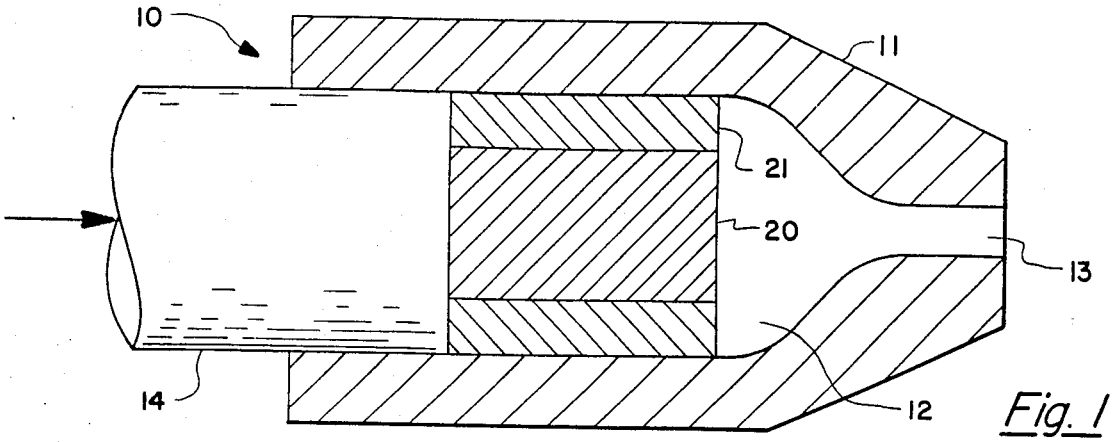
FIG. 1 is a schematic illustration, partially in section, of a portion of extrusion apparatus with a slug of composite material in the chamber thereof prior to initiation of the extrusion process.
Figure 2:
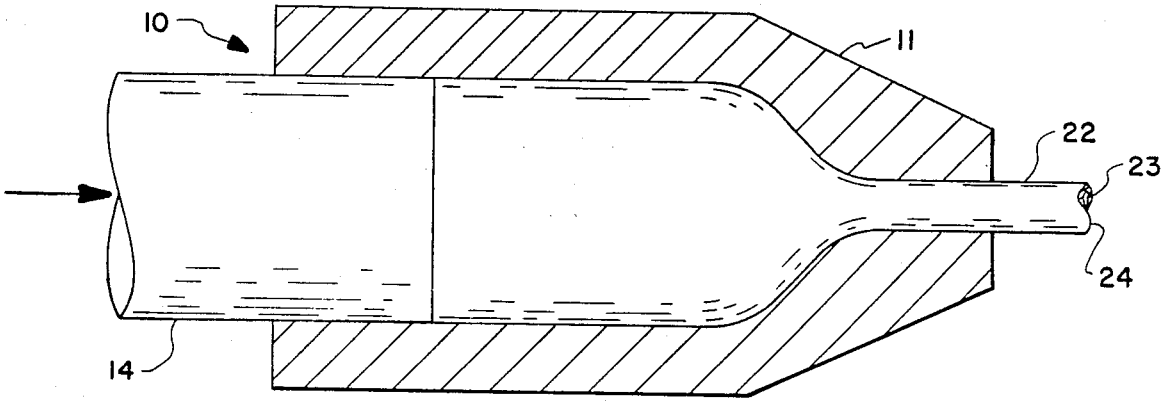
FIG. 2 is a view of the apparatus of FIG. 1 during the extrusion process and showing the slug being formed into a wire.

In FIGS. 1 and 2, reference numeral 10 generally identifies an extrusion press having a die 11 with a cylindrical cavity 12 therein terminating in a nozzel 13. A ram 14 is adapted to be driven by means not shown to slide within cavity 12 and extrude material therein through nozzel 13.

Located within chamber 12 is a composite slug of electrically conductive materials comprising a cylindrical core or billet 20 of a metal oxide such as silver cadimum oxide or sliver tin oxide having nonwelding properties. Surrounding core 20 is a sheath or sleeve of a metal alloy having good welding properties, such as fine silver, silver cadimum or silver tin. Sleeve 21 may have been formed by casting a tubular section of the desired metal, and machining it as necessary to provide an appropriate inner diameter for accommodating billet 20 and a wall thickness which, after extrusion and other processing, will provide a layer of the appropriate thickness on the core material of billet 20.

Figure 3:
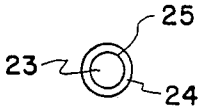
FIG. 3 is a cross-sectional view of the wire shown in FIG. 2.

The extrusion process is carried out at a temperature which is sufficiently high to produce a desired degree of plasticity of the materials of core billet 20 and sleeve 21. As shown in FIGS. 2 and 3, the result is a wire 22 having a core 23 of the metal oxide of billet 20 surrounded by an outer layer 24 of the metal of sleeve 21. The pressure and temperature utilized in the extrusion process cause a metallurgical bond at the interface 25 between core 23 and outer layer 24. Accordingly, the bond provides excellent adhesion between the materials.

After extrusion, wire 22 is cold drawn and annealed one or more times to achieve desired wire dimensions and temper. Because of the hardness and brittleness of the oxide materials under consideration, the maximum reduction which can be achieved with acceptable results during a cold drawing operation is approximately 20%. It is, however, pointed out that having the core material confined within a layer of more ductile material provides more latitude in working the core material during both the extrusion and cold drawing processes.

Figure 4:
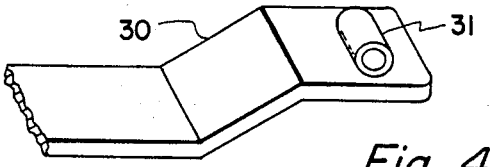
FIG. 4 is a partial perspective view of a contact carrier having a segment of the wire of FIGS. 2 and 3 welded thereon.
Figure 5:
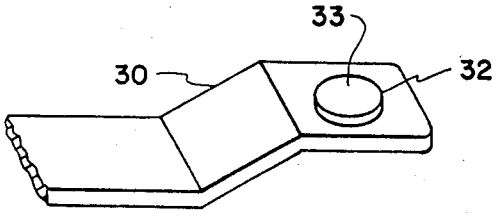
FIG. 5 is a view of the contact carrier of FIG. 4 after the segment of wire thereon has been coined into a desired contact shape.

FIGS. 4 and 5 illustrate how segments of wire 22 may be used to form an electrical contact in a switch contact assembly. Reference numeral 30 identifies a contact carrier typically stamped from a copper or copper alloy sheet or strip. Reference numeral 31 identifies a wire segment sheared from wire prepared as previously described. Since the outer layer of wire 31 is of a material which has good welding properties, it can be easily and securely welded to carrier 30 by conventional resistance welding techniques. Following welding of wire segment 31 to carrier 30, the wire segment is coined into a desired contact shape 32 as shown in FIG. 5. The coining operation leaves a thin layer of the metal or metal alloy of sleeve 21 on electrical contact surface 33. Although such material has good welding properties and would not normally be suitable for the electrical contact surfaces of a high voltage or high current switch, it has been found that if this layer is kept in the order of 0.003 inches, it oxidizes during the course of a few switch operations to form a material having properties similar to the nonwelding properties of the underlying metal oxide.

Fabrication of the contact assembly has been described as several discrete steps. However, on a modern high speed integrated manufacturing machine, shearing of a wire segment 31, resistence welding it to a contact carrier and coining it into a desired contact shape occurs almost simultaneously at a single station. Wire for forming segments 31 and a strip of contact carriers 30 may be continuously fed to the station, thereby resulting in a very high production rate. Thus, it can be seen that the composite contact material devised by the applicant is well suited to modern high speed production proceses. Furthermore, the composite contact material is relatively inexpensive to produce, is readily attached to a contact carrier by conventional resistance welding techniques, and results in a high capacity electrical switch with excellent resistance to contact fusion.

Although the applicant's method has been described in a particular form for illustrative purposes, various modifications to the disclosed method which do not depart from the applicant's contemplation and teaching will be apparent to those of ordinary skill in the relevant arts. It is intended that coverage not be limited by the particular details disclosed, but only by the terms of the following claims.

The embodiments of the invention in which an exclusive property or right is claimed are defined as follows:

1. A method of producing a nonwelding contact assembly for an electrical switch, comprising the steps of:

forming a cylindrical billet of a first non-welding metallic material;

forming a tubular section of a second metallic material having good welding properties configured to fit over said cylindrical billet;

inserting said cylindrical billet into said tubular section to form a slug having a core of the first material and a sheath of the second material;

extruding said slug at an elevated temperature to form a wire having an outer layer of the second material metallurgically bonded to a core of the first material;

forming a switch contact carrier;

welding a segment of said wire containing sufficient material to form a desired contact configuration to said contact carrier; and coining the segment of wire welded to the contact carrier to form a contact having an electrical contact surface thereon.

2. The method of claim 1 wherein said tubular section is formed by casting a tube of the second metallic material.

3. The method of claim 2 wherein the step of extruding said slug at an elevated temperature to form a wire is followed by the steps of cold drawing and annealing the wire to achieve a desired final dimension and temper.

4. The method of claim 3 wherein the dimensions of said billet and said tubular section and the variables of said coining process are selected to produce a layer of the second metallic material having a thickness in the range of 0.002 to 0.004 inches on the electrical contact surface of said contact.

5. The method of claim 4 wherein the first metallic material is silver cadimum oxide.

6. The method of claim 5 wherein the second metallic material is a silver cadimum alloy.

7. The method of claim 5 wherein the second metallic material is fine silver.

8. The method of claim 4 wherein the first metallic material is silver tin oxide.

9. The method of claim 8 wherein the second metallic material is a silver tin alloy.

10. The method of claim 8 wherein the second metallic material is fine silver.

11. A method of producing a welded electrical contact assembly having a contact with nonwelding characteristics at its electrical contact surface, comprising the steps of:

producing a slug having a core of a first metallic material exhibiting nonwelding chracteristics and having a sheath of a second metallic material exhibiting good welding characteristics;

extruding the slug to form a wire of the first metallic material having a layer of the second metallic material bonded thereto, the extrusion process and dimensions of the core and sheath being selected to produce a metallurgical bond between the first and second materials;

forming an electric contact carrier of a metal exhibiting good welding characteristics;

welding a segment of said wire containing sufficient material to form a desired contact configuration to the contact carrier; and coining the segment of wire welded to the contact carrier to form an electrical contact.

12. The method of claim 11 wherein the step of extruding the slug is performed at an elevated temperature.

13. The method of claim 12 wherein the sheath of a second metallic material is formed by casting and the desired final dimensions for the sheath are achieved by machining.

14. The method of claim 13 wherein the first metallic material is silver cadimum oxide and the second metallic material is a silver cadimum alloy.

15. The method of claim 13 wherein the first metallic material is silver cadimum oxide and the second metallic material is fine silver.

16. The method of claim 13 wherein the first metallic material is silver tin oxide and the second metallic material is a silver tin alloy.

17. The method of claim 13 wherein the first metallic material is silver tin oxide and the second metallic material is fine silver.

* * * * *